United States Patent [19]

Ramp

[11] 3,974,047

[45] Aug. 10, 1976

[54] ELECTROLYTIC CATION EXCHANGE PROCESS FOR CONJOINT MANUFACTURE OF CHLORINE AND PHOSPHATE SALTS

[75] Inventor: Floyd Lester Ramp, Richfield, Ohio

[73] Assignee: The B. F. Goodrich Company, Akron, Ohio

[22] Filed: June 2, 1975

[21] Appl. No.: 582,706

[52] U.S. Cl. ..... 204/90; 204/128; 204/129; 204/294; 204/296

[51] Int. Cl.[2] ..... C25B 1/00; C25B 1/02; C25B 1/26; C25B 11/12

[58] Field of Search ..... 204/90, 128, 129, 294, 204/296

[56] References Cited

UNITED STATES PATENTS

| | | | |
|---|---|---|---|
| 3,763,005 | 10/1973 | Butre et al. | 204/90 |
| 3,773,634 | 11/1973 | Stacey et al. | 204/98 |

*Primary Examiner*—R. L. Andrews
*Attorney, Agent, or Firm*—Alan A. Csontos

[57] ABSTRACT

Process electrolyzes hot, concentrated solutions of (1) as an anolyte, an essentially saturated aqueous solution of an alkali metal chloride and (2) as a catholyte, an aqueous solution containing 10 to 75%/wt. of phosphoric acid separated by a special high-normality cation exchange membrane producing anodic chlorine of high purity, cathodic hydrogen also of high purity and in the catholyte an alkali metal phosphate. The process operates at temperatures of 75° to 105° at highest current efficiencies and with low power consumption. With a KCl anolyte, potassium phosphate salts of any desired K:P molar ratio are formed in the catholyte and which are useful in fertilizer and detergent applications. The process requires a cation exchange membrane of normality in the range of 0.2 to 10 N or higher in which a significant proportion of the anion sites may not be covalently-bound to the material of the membrane. Graphite electrodes are especially satisfactory in the process including specifically an anodized graphite anode and a ruthenium metal coated graphite cathode.

13 Claims, 10 Drawing Figures

K/P=3:1
K/2=2:1 = pH 9
K/P=1:1 = pH 4.5
KOH·H2O
KOH·2H2O
K3PO4·3H2O
K2HPO4
K2HPO4·3H2O
3K2HPO4·KH2PO4·2H2O
KH2PO4·2K2HPO2·H2O
K3PO4·7H2O
K2HPO4·6H2O
KH2PO4
50°C
25°C
0°C
KH2PO4
KH5(PO4)2
2H3PO4·H2O
WEIGHT PERCENT K2O
WEIGHT PERCENT P2O5
0
10
20
30
40
50
60
70
80

KH2PO4
PRODUCTION of KH2PO4
81%
76%
49%
75°C
(Estimated)
20°C
H3PO4
75%
69%
41%
H2O

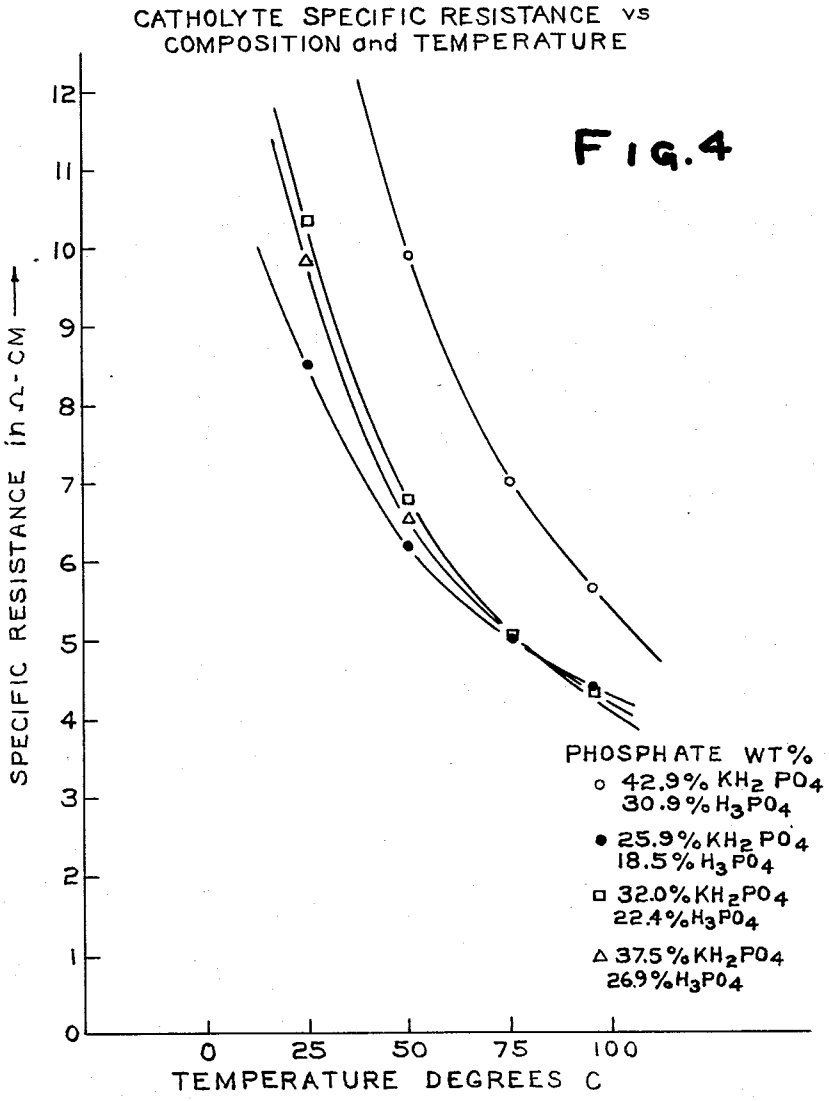
CATHOLYTE SPECIFIC RESISTANCE vs COMPOSITION and TEMPERATURE
FIG. 4
PHOSPHATE WT%
○ 42.9% $KH_2PO_4$ 30.9% $H_3PO_4$
● 25.9% $KH_2PO_4$ 18.5% $H_3PO_4$
□ 32.0% $KH_2PO_4$ 22.4% $H_3PO_4$
△ 37.5% $KH_2PO_4$ 26.9% $H_3PO_4$
SPECIFIC RESISTANCE in Ω-CM
TEMPERATURE DEGREES C
0
1
2
3
4
5
6
7
8
9
10
11
12
25
50
75
100

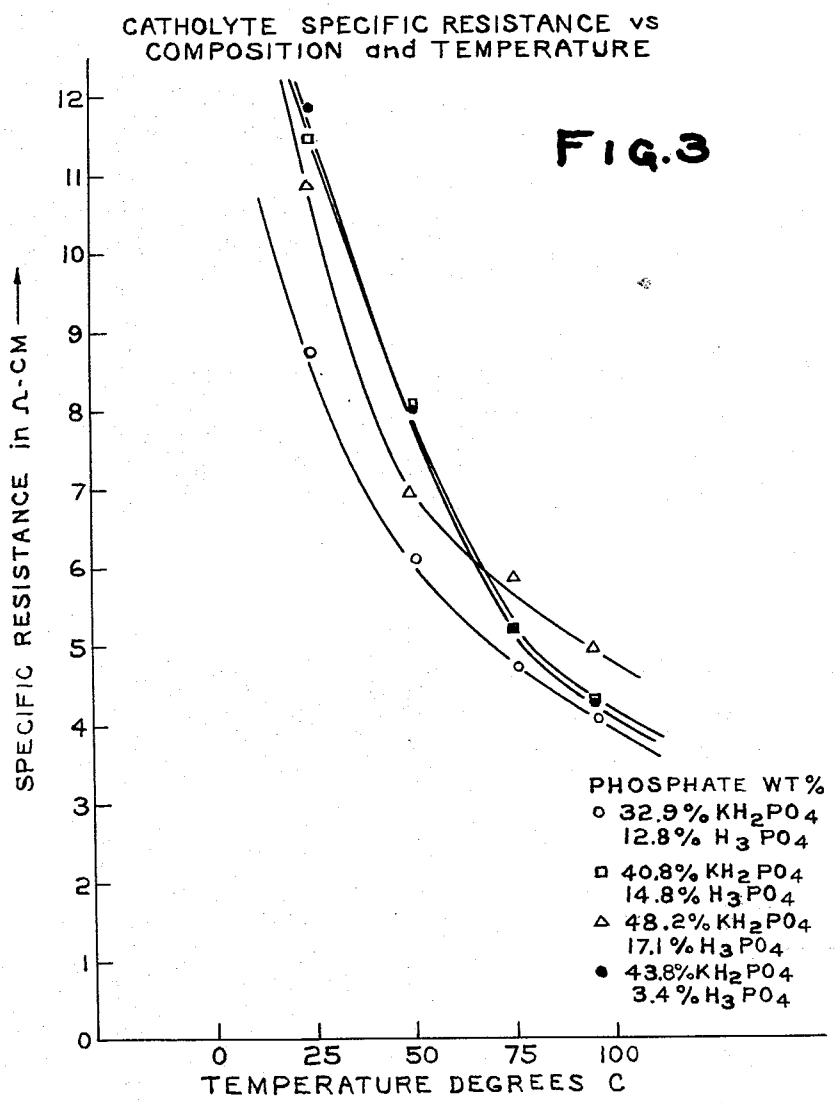
CATHOLYTE SPECIFIC RESISTANCE vs COMPOSITION and TEMPERATURE
FIG. 3
PHOSPHATE WT%
○ 32.9% $KH_2PO_4$ 12.8% $H_3PO_4$
□ 40.8% $KH_2PO_4$ 14.8% $H_3PO_4$
△ 48.2% $KH_2PO_4$ 17.1% $H_3PO_4$
● 43.8% $KH_2PO_4$ 3.4% $H_3PO_4$
SPECIFIC RESISTANCE in Ω-CM
TEMPERATURE DEGREES C
0
1
2
3
4
5
6
7
8
9
10
11
12
25
50
75
100

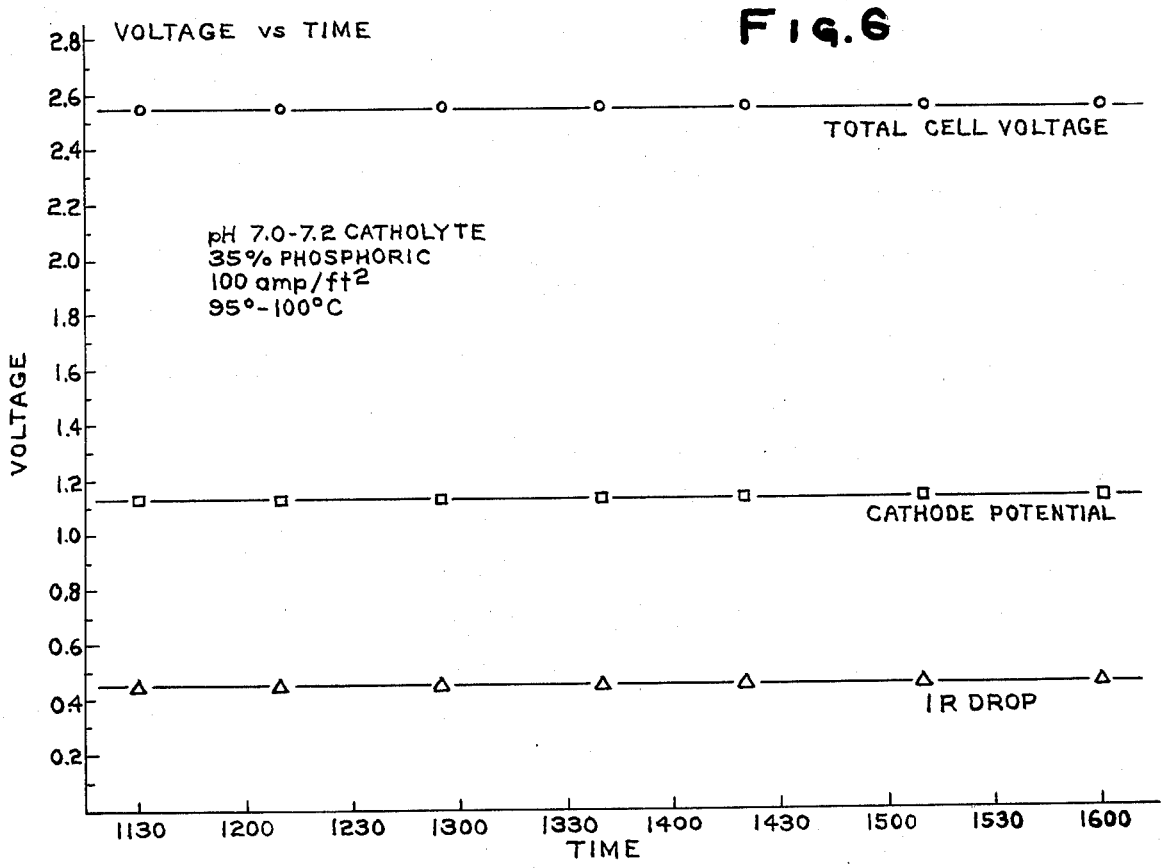
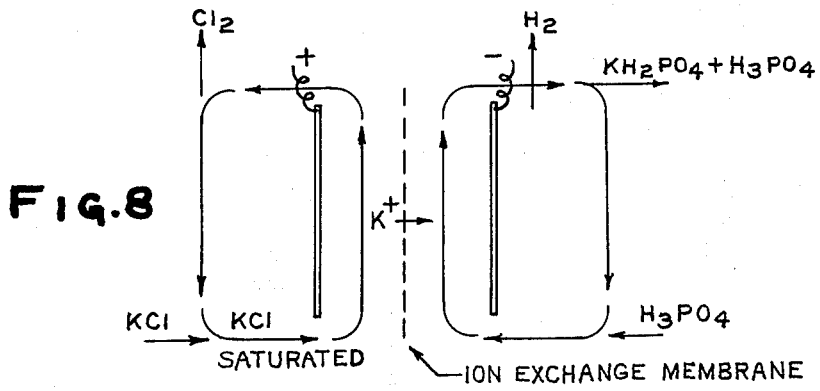
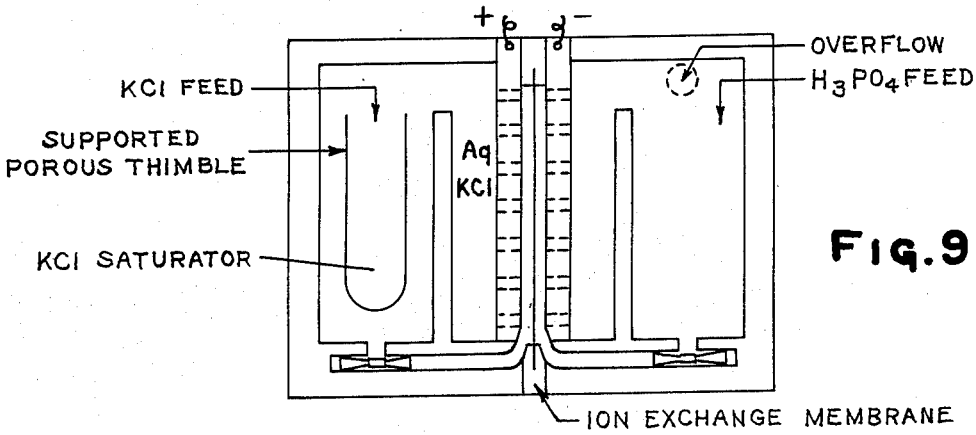
FIG. 9

ELECTROLYTIC CATION EXCHANGE PROCESS FOR CONJOINT MANUFACTURE OF CHLORINE AND PHOSPHATE SALTS

RELATED APPLICATIONS

My copending application, Ser. No. 582,707 filed on June 2, 1975, discloses and claims high-normality membranes and their production, which membranes are useful in the process of this invention. My copending application, Ser. No. 582,708, filed on June 2, 1975 discloses and claims an electrolytic cation exchange process producing chlorine and caustic utilizing a special high-normality cation exchange membrane containing electro-negative oxide complexes of tantalum or niobium.

BACKGROUND OF THE INVENTION

The present invention relates generally to the production of chlorine by electrolysis. More specifically, the present invention relates to the conjoint production by an electrolytic cation exchange method of high purity elemental chlorine, high purity hydrogen, and alkali metal phosphates. Most specifically, the present invention relates to the conjoint synthesis of elemental chlorine and sodium or potassium phosphates from, respectively, sodium chloride or potassium chloride and phosphoric acid.

The world requirements for elemental chlorine grows at a very rapid rate. There is a similar but even larger increase in world food requirements and in the concomitant rate of fertilizer usage, especially in arid regions. The existing chlor-alkali processes based on sodium chloride are limited, on the one hand, by the need for the disposal at economic prices of large quantities of caustic and, on the other, by energy and environmental limitations. Where the more efficient mercury cathode cell is employed in the latter processes, there is the possibility of escape of mercury to the atmosphere and to streams and lakes. Also, brine purification and for most chlor-alkali processes and especially for the mercury cathode version is a continuous source of operating problems. A need exists, therefor, for a chlorine process which does not produce caustic, which involves minimal pollution risk, which is tolerant of brine and other raw material impurities, and which produces needed chlorine and phosphate salts with great efficiency.

For many years agricultural researchers have experimentally shown the great value of potassium phosphates as a single source of the potash and phosphorous so needed in fertilizers for good plant growth. Such phosphates are completely consumed leaving no residual ions to pollute the soil. Moreover, the potassium phosphates can be polymerized or condensed to have any desired water solubility and a range of potassium and phosphate release rates as well as offering a means of minimizing phosphate run-off to streams and lakes. The build-up of undesired acid ions in the soil, for example chloride ion from the "muriate of potash" (KCl) of the fertilizer industry, is especially bad in arid agriculture such as the irrigated farming of the Western United States and in the Middle East where sufficient water may not always be available to reduce such build-up by leaching.

However, after nearly a quarter century no proven, large scale commercial process is in operation producing large volumes of potassium phosphates at economic prices, particularly of the highly desirable $KH_2PO_4$. Workers at the Tennessee Valley Authority reacted phosphorous pentoxide with potassium chloride and water at 1450° to 1650°F to produce potassium metaphosphate and by-product hydrogen chloride. The process suffered from the high costs incident to the use of $P_2O_5$ and to the disposal of hydrogen chloride and, in addition, corrosion of equipment was reported as severe. Another known method not yet in large scale use involves reacting KCl and $H_2SO_4$ producing $KHSO_4$ carried in $H_2SO_4$ and liberating hydrogen chloride followed by reacting the $KHSO_4/H_2SO_4$mixture with phosphate rock to produce $KH_2PO_4$ in $H_3PO_4$, and lastly by adding a precipitant such as methanol or acetone to precipitate the desired $KH_2PO_4$. The latter process also requires an economical use to dispose of very large quantities of hydrogen chloride; it seems potentially subject to severe equipment corrosion; it appears to involve only partial conversion of the phosphoric acid; and it seems to involve several potentially difficult separation steps.

There exists a great need for a lower cost route to high purity chlorine and a low cost, practical method for producing sodium and potassium phosphates.

PRIOR ART

The electrolysis of mixed solutions of an alkali metal chloride and of a strong mineral acid is known. For example, U.S. Pat. No. 3,269,926 (corres. to W.German Pat. No. 1,142,345) discloses a single solution process involving the electrolysis of a suspension of a solid alkali metal chloride carried in an aqueous solution of phosphoric acid producing chlorine, hydrogen and an alkali metal phosphate. The cell voltage required in this process appears high (3.8 volts for NaCl; 3.7 volts for KCl) and the current efficiencies appear modest (about 83 – 87%) making the process costly in terms of power consumption. Also, the process requires either batchwise operation requiring long times to take the content of alkali metal chloride down to acceptable levels or the use of complicated procedures to separate the alkali metal phosphates from unconverted chloride salts. Despite high concentrations of solid alkali metal chloride in the cell liquor, the actual concentrations of dissolved chloride ion at the anode electrode surface are low due to the lowered solubility of the chlorides in aqueous $H_3PO_4$ solutions. The patent says that the process can be carried out in known types of diaphragm cells when separate collection of chlorine and hydrogen is required.

U.S. Pat. No. 3,278,403 (corres. to Belgium Pat. No. 621,091) discloses a single solution process involving the electrolysis of a mixed aqueous solution of an alkali metal chloride and a strong mineral acid such as $H_2SO_4$, $HNO_3H_3PO_4$. The U.S. patent is limited to the use of nitric acid producing an alkali metal nitrate and liberating mixed nitrogen oxides as products. The concentration of dissolved alkali metal chloride at the anode in this process is as low or even lower than in U.S. Pat. No. 3,269,926 and produces an electrolyzed liquid containing an appreciable concentration of unreacted chloride salt from which the desired nitrate salt must be separated by tedious and expensive methods. Such a process would have low productivity, high electrical power costs and high heat energy costs.

East German Pat. No. 93,754 deals with the above and other prior art processes and proposes as a replacement therefor an electrolytic process employing a cell wherein a cation exchange membrane separates an anode compartment containing a solution of an alkali metal chloride from a cathode compartment containing an aqueous solution containing 25 – 40%/wt. of phosphoric acid. The cell disclosed employs metal electrodes, the anode electrode being a sheet of titanium coated with platinum metal and the cathode electrode being a perforated sheet of copper. The process is said to be operated at temperatures of 50° to 70°C. Such process operates with modest current efficiencies of 70 – 87% with high cell resistance, and would incur very high electrode costs in a commercial sized plant since the metal cathodes described would dissolve in the solutions under long-continued electrolytic conditions. Metals normally self-protective by an oxide film are, in the presence of phosphoric acid, rapidly eroded when an electrolytic current makes the metal cathodic in nature.

SUMMARY OF THE INVENTION

The process of the present invention marries the needs for chlorine and for sodium and potassium phosphates and avoids the above and other problems by providing an electrolytic cation exchange process utilizing a special, high normality cation exchange membrane between a separate, highly concentrated solution of alkali metal chloride and a separate concentrated solution of phosphoric acid permitting operation at high temperatures, at high current densities, at very low cell voltages, and at essentially 100% current efficiencies.

In the process of this invention, the anolyte solution is in direct contact with one side of the membrane and the catholyte is in direct contact with the other side. Hot, very concentrated solutions are employed with an anolyte essentially saturated in alkali metal chloride and a catholyte containing from about 10% to about 75%/wt. of phosphoric acid, more preferably between about 25% and about 60%/wt. of phosphoric acid. Direct current is passed in series through the anolyte, the membrane and the catholyte solution while makeup alkali metal chloride and water is added to the anode compartment to maintain essentially a saturated condition whilst aqueous phosphoric acid is added to the cathode compartment to replace the phosphoric acid removed as phosphate salts. The rate of phosphoric acid feed determines the K/P ratio of the product, Chlorine gas is taken off the anode side of the cell and hydrogen gas from the cathode side. Both gases are of high purity due to the complete separation maintained by the membrane.

Known forms of cation exchange membranes exert a greater resistance than desired to the transfer of the alkali metal cation into the catholyte solution. Such known membranes also permit transfer of some chloride ion to the catholyte and of some phosphate ion to the anolyte; causing high rates of electrode attack; lower current efficiency for chlorine and chloride contamination of the phosphate. Such forms of cation exchange membranes appear to have too low a concentration of covalently-bound anion sites to be sufficiently permselective under the very high salt and acid ion concentrations at which the process of this invention operates. The alkali metal halide compound penetrates the membrane and deposits both within and on the cathode side of the membrane very materially raising the resistance of the membrane. It is not ordinarily possible to incorporate in a membrane the very high concentrations of anion sites required for the needed high permselectivities when relying solely on anion sites chemically united or covalently-bound in the material of the membrane. High-normality membranes having only chemically-bound anion sites would be physically too weak and too water-sensitive for use in commercial-size chlorine cells.

The present invention requires a high normality cation exchange membrane in which a very significant proportion of the anion sites are not chemically-combined or covalently-bound in the material of the membrane. Such anions in the special membranes are bulky polyvalent anions each containing a plurality of negative charges electrostatically-entrapped in the ionic channels of the membrane by a sort of push-push repulsion between the trapped anions and the covalently-bound anion sites of the material of the membrane. For use in the electrolytic process of this invention, the special membrane should be between about 0.2N to about 4.0N or more ion in total anion sites only between about 0.01 and 0.1 N accounted for by covalently-bound anion sites. The conductance method used to define the normality is defined in the section "High Normality Membranes" of my copending application, Ser. No. 582,707 mentioned above.

Preferred for use in membranes in the process of this invention are electrostatically-entrapped polyvalent metal phosphate ions which not only are bulky and have a plurality of the same negative electric charges as the covalently-bound anions but also are of reduced mobility once in place and are not eluted either by current flow or by action of the cell solutions. Greatly preferred are negatively-charged iron phosphate anions although aluminum phosphate anions also are efficient.

Such membranes can be prepared by procedures shown below herein and shipped to the chlorine plant in either the dry or water-wet condition.

My process is operated with the anolyte and catholyte solutions at an elevated temperature permitting maximum solution concentration of the alkali metal chloride in the anolyte solution; highest saturation solubility of the alkali metal phosphate in the catholyte solution; highest rates of cation transfer; and lowest cell voltage. While the solubility of sodium chloride in water decreases slowly with increasing temperature in the range of 25° to 100°C, the total difference in solubility is not large in the narrower range where my process should be operated. On the other hand, the solubility of potassium chloride in water increases somewhat with increasing temperature being about 0.567 gram per gram of water at 100°C as contrasted with about 0.347 gram/gram at 5°C. Maintaining high dissolved phosphate salt concentration just below saturation in the catholyte solution leaving the cell is very important to process productivity. Below about 75°C cell voltage is high due to solution resistance. Between about 90°C and 105°C the changes in cell voltage is smaller. At 105°C or higher water is boiled from the solutions unless the cells are operated under pressure which does not appear to be economic due to increased equipment and operating costs. For these and other reasons, my process should be operated between about 75° and about 105°C with between about 90° and up to about 99°C being much preferred. Materials of cell construction such as chlorinated polyvinyl chloride, phenolic resins, etc., which are able to withstand corrosion at the temperatures specified are inexpensive and readily available.

In the process of this invention, the pH of both anolyte and catholyte are lower than in many of the known electrolytic processes for chlorine. Due to the high permselectivity of the membrane utilized, the inherent pH of the anolyte is quite low in the range of 1 to 3. Likewise, at start up, the catholyte pH is very low in the order of 1–2 as is characteristic of strong solutions of phosphoric acid. At equilibrium operating conditions under several preferred mode of operation, the catholyte will be at or below the neutral point in pH. Under these conditions, known types of metal electrodes are not at all satisfactory. Metal cathodes, particularly in the presence of phosphoric acid and when made cathodic by high density current flow, are rapidly eroded and the catholyte contaminated by extraneous metal phosphate complexes. Even noble metal cathode coatings such as platinum are removed in a very short period of operation. Metal anodes such as the expensive so-called "dimension ally-stable anode" or "DSA" anode which is reputed to be made of titanium metal or titanium alloy and coated with a noble metal such as platinum are rapidly eroded by the highly acidic anolyte medium. Apparently, the metal oxide surfaces on which metal electrodes have depended for their resistance to electrolytic attack are rapidly reduced in such acidic environments.

I have found that, of known cathode materials, only graphite is satisfatory for long term service. While the use of graphite electrodes in other processes usually exacts a penality of higher electrode potentials, especially at the cathode.

Graphite cathodes coated with ruthenium exhibit in the process of this invention very low and very stable cathode potentials in the range of only about 0.3 to 1.0 volt vs standard calomel electrode on catholyte pH. Ruthenium is quite unique in its ease of electrolytic deposition on graphite surfaces from operating catholyte solutions containing phosphoric acid and, moreover, the coating thus deposited is quite tenaciously retained over a wide range of catholyte pH ranging from the highest concentrations of phosphoric acid at which the process operates (75%/wt.) up to a pH of about 7, and perhaps as high as 9.

As indicated, the process of this invention forms the alkali metal salts of phosphoric acid in the cathode compartment of the electrolysis cell. It is a very special advantage of the process that the two-solution mode of operation with high permselectivity membranes maintains a very low chloride ion concentration in the catholyte thereby greatly simplifying cathode liquor handling and the recovery and utilization of the phosphate salts. As a result, several very simple and inexpensive ways in which to use or workup the cathode liquor overflowing from the cell are practicable.

For example, such cathode liquor of the desired $K_2O$:P molar ratio can be utilized as is an additive to aqueous liquid fertilizer formulations supplying the potash and phosphorous requirements for the liquid fertilizer application in question.

Also, if the cell is operated at a cathode pH higher in the usable range, for example between about 5 and about 9, the higher K:P molar ratio therein can be reduced by addition of commercial phosphoric acid to catholyte overflow to obtain a desired lower K:P ratio where the solubility of the salt content is lower and rapid precipitation of a significant proportion of the phosphate salt content occurs exterior to the cell.

Irrespective of the K:P ratio in the cathode liquors withdrawn from the cell, addition thereto of a lower aliphatic alcohol of 1–4 carbon atoms per molecule will effect essentially complete precipitation of the phosphate salts therein. Acetone may also be utilized for the same purpose. After such a precipitation there remains a residual mixed alcohol- or acetone-phosphoric acid solution from which the alcohol or acetone is recovered by distillation leaving in turn a residual aqueous phosphoric acid solution which optionally can be reconstituted with added phosphoric acid and/or by concentration for return to the cell or which may be neutralized with caustic, ammonia and/or other nitrogenous bases to obtain additional phosphate salts useful in fertilizer applications.

Since phosphoric acid exhibits a strong tendency to complex with and/or sequester polyvalent metal ions, it is relatively easy to add to cathode liquors overflowing the cell the trace metals, for example, cobalt, copper, manganese, magnesium, and the like, thought desirable in a given solid or liquid fertilizer application. Subsequent precipitation of the phosphate salt content of the resulting trace metal beneficiated cathode liquor will bring down the trace metals admixed with the alkali metal phosphate salts. Still other procedures of equal simplicity are possible.

Crude, low cost commerical forms of phosphoric acid contain fluosilicate which must be removed. In the presence of fluosilicate a sparingly soluble potassium or sodium fluosilicate forms on the cathode side of the membrane. The resistance then rises excessively. Fluosilicate is conveniently precipitated from the phosphoric acid feed by addition of catholyte, i.e., potassium phosphate solution.

Likewise due to high membrane selectively preventing contamination of the anolyte by phosphate ion and other cathode compartment ions, it is only necessary to add make-up alkali metal chloride and water to the anolyte solution. Where crude alkali metal chloride brines are being employed as the anolyte feed source, a small slipstream of the hot anolyte liquid can be withdrawn either periodically or more or less continuously from the anode compartment and treated to precipitate out and/or remove polyvalent metal and other impurities which may increase with the time of continuous cell operation. Solid KCl prepared by the crystallization method can be used in its as received form while the flotation-grade solid KCl contain impurities notably organic acids which must be removed before being added to the cell.

While removal of solid or solid-forming impurities is desirable, few of the impurities in crude alkali metal chloride brines and crude phosphoric acids interfere with the actual operation of the cell in my process to the extent which is suffered, for example, by the mercury cathode chlor-alkali process where polyvalent metal impurities in the brine can convert the mercury/-sodium amalgam cathode liquid to "cathode butter" so viscous as to require cell shutdown. Solid precipitates circulating in the liquids of the two cell compartments of the process of this invention can lead to erosion of graphite electrodes which can be avoided by filtration of cell liquors which are much simplified due to the lowered compositional complexity of the two separate solutions due to low cross-contamination of the compartments.

The process of the present invention has special application to KCl as the alkali metal chloride anolyte ingredient and to any of the aqueous solution forms of phosphoric acid as the mineral acid catholyte ingredient. There are huge deposits of potassium ores, especially in the Province of Saskatchewan in Canada. In Germany also, potash reserves are large. Total world potash ($K_2O$) reserves are said to be in excess of 68 billion tons, a total adequate for hundreds of years. The Saskatchewan ores contain potassium as the chloride in more than 35%/wt. concentration. Production of potash was reportedly as much as 20 million tons in 1970 and new production capacities are being added and can be added rapidly as need requires.

Likewise, phosphate rock reserves are large, especially in the U.S. where production of wet process phosphoric acid is rising rapidly. Consumption of fertilizers is also increasing rapidly, especially outside of the U.S., and will lead to ever greater production of wet process phosphoric acid. The process of this invention employed to produce elemental chlorine and potassium phosphates makes it a unique partner of the chemical and fertilizer industries producing two high-demand chemicals from inexpensive raw materials in almost unlimited supply.

BRIEF DESCRIPTION OF THE DRAWINGS

FIG. 3 is a plot of the catholyte specific resistance as a function of composition and temperature.

FIG. 4 is a plot similar to that of FIG. 3 but other catholyte compositions.

FIG. 6 is also a plot of data from the $KCl/H_3PO_4$ version of the process when operating with a catholyte containing 45%/wt. of phosphoric acid at 95° – 100°C over a range of catholyte pH from 7.0 to 7.2 with a ruthenium-coated graphite cathode, the plot having potentials in volts plotted as ordinates and cell operating time in minutes as abscissae, the plot showing plot lines for each of total cell voltage, cathode potentials vs standard calomel electrode (SCE), and cell IR drop.

FIG. 8 is a simplified process flow diagram representing cell operation during the process of the invention; and FIG. 9 is a side view in section of a laboratory type cell in which much of the data herein is obtained.

RAW MATERIALS

Figure 1:
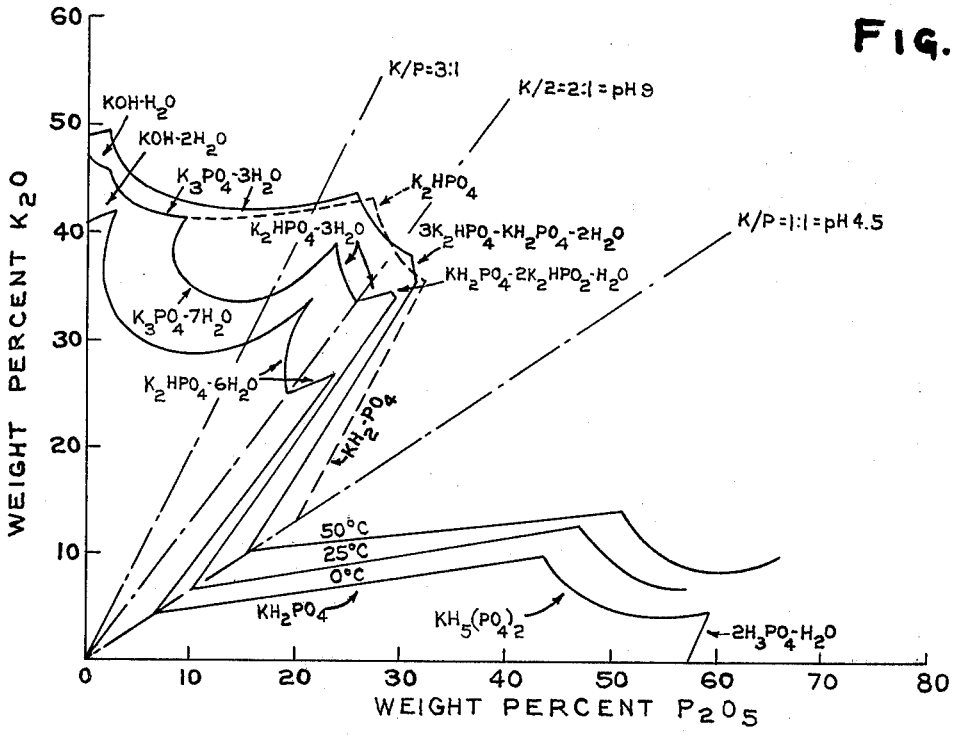
FIG. 1 of the drawings is a compositional diagram drawn from the literature for the system $K_2O$—$P_2O_5$—$H_2O$ at temperatures of 0° to 75°C, in which the weight percent of $P_2O_5$ is plotted as abscissae and the weight percent of $K_2O$ is plotted as ordinates, the various lines showing solubility limits for the indicated potassium phosphate salts at the indicated temperatures.

The anolyte ingredient may be any chloride of an alkali metal, including those of lithium, sodium, potassium or rubidium. Due to the lesser supplies of raw materials for lithium and rubidium and considerably larger requirements for salts of sodium and potassium, it is preferred to employ chlorides of alkali metals of atomic number 11 to 19, i.e. sodium and potassium chlorides. Potassium chloride is preferred by reason both of its higher solubility in water at high temperature and the unique value of potassium salts in fertilizer. The method of this invention is capable of operating at catholyte pH at which the sodium or potassium monohydrogen phosphates are produced and which can be converted to the corresponding pyrophosphates useful in detergents. These preferred chlorides can be obtained either in the form of any of their solids, more-or-less purified forms or in the form of their crude brines. Crude brine forms of NaCl and KCl usually contain both the sodium and potassium chlorides and, in addition, contain as principal impurities magnesium salts, calcium salts, strontium salts, sulfate salts, fluorine salts, aluminum chloride, and others. The commercially-available forms of the solid, crude "muriate of potash", a preferred raw material, may have a typical analysis* as shown in the table below.

| Component | Flotation Standard | Product Granular | Crystallization Product |
|---|---|---|---|
| $K_2O$ Equiv(Total) | 60.80 | 60.54 | 62.50 |
| KCl | 96.25 | 95.84 | 98.94 |
| Potassium (K) | 50.47 | 50.26 | 51.58 |
| Chloride (Cl) | 47.60 | 47.50 | 47.06 |
| Sodium (Na) | 1.15 | 1.13 | 0.40 |
| Calcium (Ca) | 0.06 | 0.09 | 0.0030 |
| Magnesium (Mg) | 0.06 | 0.09 | 0.0006 |
| Bromine (Br) | 0.06 | 0.05 | 0.0252 |
| Sulphate ($SO_4$) | 0.20 | 0.40 | 0.0180 |
| Water (Insoluble) | 0.30 | 0.40 | 0.0075 |
| Moisture | 0.10 | 0.08 | 0.015 |

*Source-Potash Company of America

Phosphoric acid is available in many different forms but invariably dissolved in water. The least expensive aqueous solution of phosphoric acid contains about 30%/wt. of $P_2O_5$ or about 41%/wt. of $H_3PO_4$ but, due to the high cost of shipping dilute solutions, this type are not generally available except by special arrangement.

The most common form of phosphoric acid known as fertilizer-grade orthophosphoric acid contains about 54%/wt. of $P_2O_5$ or about 70%/wt. of $H_3PO_4$. Use of the latter would reduce the heat energy requirements of the $KCl/H_3PO_4$ process by reducing dewatering requirements over that required by more dilute acids yet permitting operation with the most preferred catholyte phosphoric acid concentrations in the range of 50 – 60%/wt. There are still more concentrated albeit more expensive forms of $H_3PO_4$ solution such as "polyphosphoric acid" and "superphosphoric acid" which can be utilized, the latter containing 68 – 72%/wt. of $P_2O_5$. Some of the forms of phosphoric acid known as "black acids" contain organic colored bodies whereas "green acid" forms do not. Since the black acids may deposit a coating on the membrane and/or cathode producing higher IR drops, it is preferred to remove the colored material from black acid or use the green acid forms.

Common wet-process orthophosphoric acid solutions contain as impurities calcium phosphates, silicon or silicic acid residue, aluminum phosphates, iron phosphates, fluorine compounds notably as fluosilicates, sulfate compounds, uranium compounds, vanadium compounds, and others. The fluorine compounds can be deleterious in the process of this invention if silicon is present either in the phosphoric acid feed or is present as a material of construction of the cell since the sparingly-soluble potassium fluosilicate compound could be formed during electrolysis. However, the phosphoric acid feed can be treated with sodium or potassium silicate or hot crude catholyte to cause separation of the fluorine moieties as the corresponding insoluble fluosilicate compound which may be removed by filtration. All of the other types of impurities in raw materials are well tolerated by the process of this invention, and moreover, depending on the work-up procedure applied to the catholyte removed from the cell, may not build-up in the catholyte solution.

PROCESS CONDITIONS

ANOLYTE SOLUTION

The process requires for best efficiencies high anolyte chloride concentrations just below saturation of the alkali metal chloride anolyte ingredient at the operating anolyte temperature. With the strongly preferred KCl, there can be respectively from about 0.10 and to just below about 0.567 gram, more preferably between about 0.4 to about 0.55 gram, of KCl per gram of water in the solution in the temperature range of 90° to 105°C. Similar concentrations for NaCl are from about 0.25 to just below about 0.391 gram per gram of water, more preferably between about 0.27 and about 0.38 gram per gram. Since water is lost by the anolyte solution through the membrane, it is necessary to replace water lost by the anolyte solution by adding make-up water. With $KCl/H_3PO_4$ at high anolyte and catholyte ion concentrations there is lost from the anolyte solution about 5 moles of water for every mole of $K^+$ transmitted through the membrane. High anolyte salt concentration and lower catholyte acid concentration minimizes transport of water through the membrane.

CATHOLYTE SOLUTION

Figure 2:
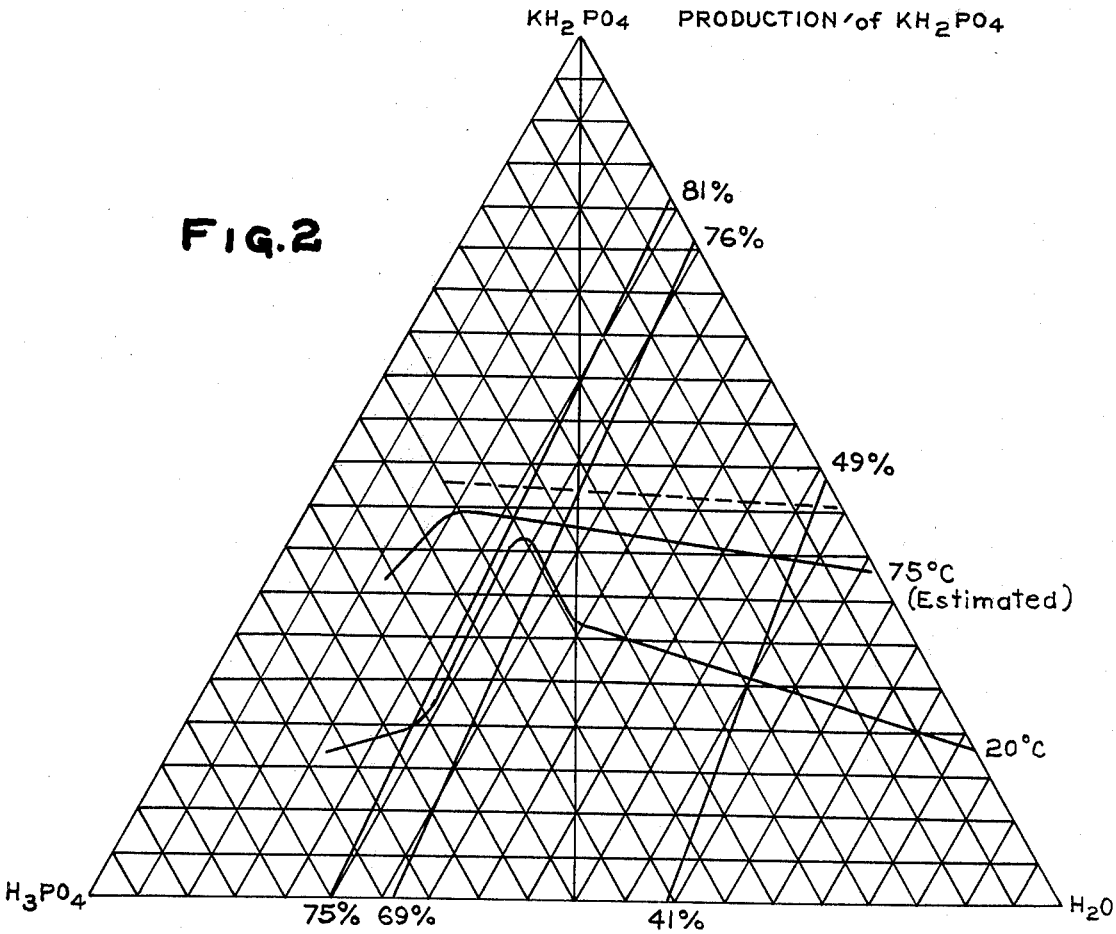
FIG. 2 is a three-phase catholyte solubility diagram for the system $KH_2PO_4/H_3PO_4/H_2O$ where the three vertices are, respectively, 100% $KH_2PO_4$, 100% $H_3PO_4$ and 100% water, the diagram showing by labelled lines the solubility limits of the $KH_2PO_4$ catholyte product at temperatures of respectively, 20°, 75°, and 95°C, and showing the advantage in cell productivity at the higher temperatures.
Figure 7:
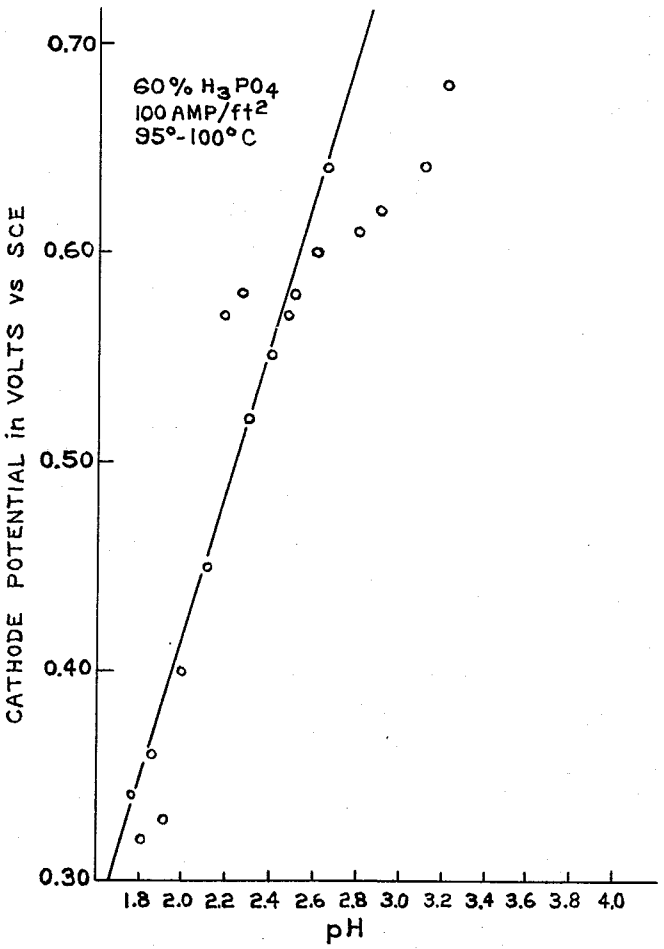
FIG. 7 is another plot of data from the operation of the $KCl/H_3PO_4$ process showing the cathode potential vs SCE as a function of catholyte pH.

The concentration relationships in the catholyte solution are much more complex than in the anolyte solution and are best appreciated by reference to the compositional diagram of FIG. 1 and the three-phase diagram of FIG. 2 of the drawings. Catholytic acid concentration can vary widely between about 10% to about 75% by weight of $H_3PO_4$ depending, in respect of the lower concentration end of the range, on the desired $K_2O/P_2O_5$ ratio in the catholyte salt product and, in respect of the higher concentration end of the range, on the raw materials and/or energy cost penalties the process user is willing to absorb arising out of the sharply increased costs of the more concentrated forms of the acid required or the amount of heat required to reconcentrate the recycle catholyte solution. A practical, economic and preferred range for the $KCl/H_3PO_4$ version of the process is to maintain between about 25% and about 75% by weight of the phosphoric acid using commerical fertilizer-grade orthophosphoric acid.

SOLUTION PH

Figure 5:
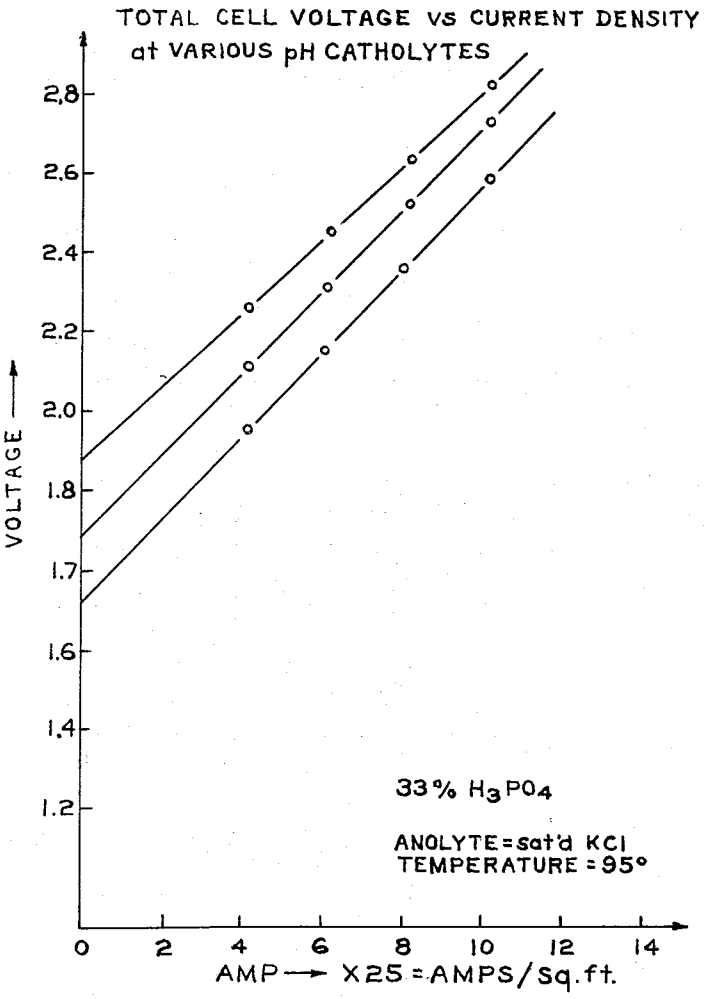
FIG. 5 is a plot of data from the operation of the $KCl/H_3PO_4$ version of the process wherein the total voltage across the cell is plotted as ordinates and current density in amperes/sq.ft. (A/ft.$^2$) is plotted as abscissae, the three plot lines showing the relationships occurring at each catholyte pH of, respectively, 2.75, 4.50 and 7.0.

The process may be operated over a fairly wide range of catholyte and anolyte pH values depending on the composition and concentration of phosphoric acid available and on the K:P molar ratio desired in the phosphate salts in the cathode liquor which overflows from the cell. In general, lower catholyte pH and higher solution temperatures favor lower cell voltages, see FIGS. 5 and 6 of the drawings. Catholyte pH also is determinative of the composition of the catholyte phosphate salt being produced and is a derivative also of the % conversion of the phosphoric acid content of the catholyte. Below are tabulated typical cathode and anode pH values obtained in the $KCl/H_3PO_4$ version of the process along with the type of catholyte salt being formed and also current efficiencies achieved by the process:

| Catholyte Salt | Catholyte pH | Anolyte pH | Current* Efficiency |
|---|---|---|---|
| $KH_2PO_4/H_3PO_4$ | 2 – 4 | 2 – 3 | >99% |
| $KH_2PO_4$ | 5.1 | 1.2 | >99% |
| $K_2HPO_4$ | 9.0 | 1.2 | >99% |
| $K_2HPO_4$ | 10.25 | 1.2 | >99% |

*Based on chlorine produced

It should be noted that at an anolyte pH greater than 4 current efficiencies are known to drop sharply. The above current efficiencies were determined by chlorine collected per Faraday or by a potassium iodide absorption technique wherein a sample of anode gas is absorbed in an aqueous potassium iodide solution with which the chlorine reacts. Residual gas in the sample is then determined by vapor phase chromatography and correction made for air. For these reasons anolyte pH should generally be maintained but normally remains in the range of from about 1 to about 4 for best operation in the anode compartment and least anode attack, and more preferably in the range of from about 1.2 to about 4. Current efficiencies referred to herein, unless stated to the contrary, are based on chlorine collected.

Catholyte pH, on the other hand can vary widely, as is shown in the above tabulation. Below are tabulated additional typical catholyte pH values versus measured cathode potentials and the K:P molar ratio of the potassium salt formed in the catholyte:

| K:P Ratio | Catholyte pH | Catholyte Potential (Volt)* | Comments on Use,etc. |
|---|---|---|---|
| 1:2 | 2 – 3 | 0.6 | Isolate salt by alcohol or acetone precipitation or use in liquid fertilizers. |
| 1:1 | 4.5 | 0.75 | Isolate by evaporation (also minimum salt solubility) for solid fertilizers. |
| 1.5:1 | 7 | 1.0 | Same as used in liquid fertilizers |
| 2:1 | 9 | 1.25 | Same - or use to make $K_4P_2O_7$ for detergent use |

*Ruthenium-coated graphite electrode in catholyte based on 35%/wt. phosphoric acid or its equivalent as phosphate salts indicated vs SCE As the catholyte pH approaches 4.5, there is a tendency for $KH_2PO_4$ to separate since salt solubility is a minimum at a K:P ratio of 1:1. As the catholyte pH is increased to 7, solubility of the salts rises to a maximum, probably because the two salts $KH_2PO_4$ and $K_2HPO_4$ are present in admixture. At about pH 9, the salt in the catholyte is largely $K_2HPO_4$ which offers greatest flexibility in all types of product use. At a pH above about 9 foaming of the catholyte has sometimes been observed at 100 – 150 Amp./ft.$^2$ current densities and such foaming may be responsible in part for decreasing current efficiencies observed. Foaming may be ameliorated by proper cell and cathode design providing adequate vapor/gas disengagement volume. Operation in the range of catholyte pH from 8 to 10 appears nevertheless to be an economical way to produce $Na_2HPO_4$ or $K_2HOP_4$ which can be utilized to produce the corresponding pyrophosphates, $Na_4P_2O_7$ and $K_4P_2O_7$, so useful in detergents. The higher water-solubility of the potassium pyrophosphate, if available at a commercially feasible price such as is possible by means of the process of the present invention, would assist in the formulation of effective detergents. Lower phosphate for a given cleaning power results in lower pollution by phosphate.

Preferred catholyte pH for the preparation of the $KH_2PO_4$ type salt is from about 1.5 and about 4.0. For the preparation of the $K_2HPO_4$ type salt, the preferred pH is from about 5.0 to about 9.0.

TEMPERATURE

As indicated, the process operates best over only a narrow range in temperature with power requirements decreasing directly with temperature in the range from about 90° to about 105°C. Also, solution conductance increases somewhat with increasing temperature. Power costs are appreciably higher below about 90°C due to rising cell IR drop as temperature is decreased. Thus, a commercial adaptation of the process will advantageously operate in the range from about 90° to about 105°C. Since water losses increase near or above 100°C, best operation appears to be between about 90° and about 99°C.

CELL VOLTAGES AND ELECTRODES

The total cell voltage required to operate a cell employing the preferred $KCl/H_3PO_4/KH_2PO_4$ version of my process is made up of a number of voltage reading from the anode to the cathode, namely, the anode potential (voltage), the resistive IR drop across the anolyte solution, the resistive IR drop across the ion-exchange membrane, the resistive IR drop across the catholyte solution, and the catholyte potential. The total IR drop across the cell (referred to herein as "cell IR drop" defined as total IR drop exclusive of electrode potentials) is very low. In typical operation with concentrated solutions at temperatures of 90° – 100°C with a catholyte containing the equivalent of 35%/wt. of phosphoric acid, such cell IR drop is rather constant at about 0.4 volt over a range of catholyte pH from about 1 to about 8. Such cell IR drop seldom goes higher than about 0.75 volt. Close spacing of the anode-membrane-cathode sandwich in the cell and the use of high normality membranes reduce the cell IR drop to very low levels.

The main contributors to total cell voltage are the anode and cathode electrode potentials which are affected strongly by solution pH, solution temperature and electrode material of construction. The electrodes will be dealt with separately below.

CATHODE ELECTRODE AND CATHODE POTENTIALS

As is shown in FIG. 3 of the drawings, catholyte conductivity is strongly affected by catholyte solution temperature making it uneconomic to operate below about 75°C. The effects of solution temperature on catholyte condutivity are modest in the range of 75° to 105°C, and especially in the narrower much preferred range of 90° to 99°C. Cathode potential is also strongly dependent on catholyte pH and also to some extent on the concentration of phosphoric acid. In the range of catholyte pH between about 1.5 to about 4, catholyte potential increases from about 0.4 volt at catholyte pH 2.4 to about 0.5 volt at pH 3.2 when operating in a catholyte containing 50%/wt. of phosphoric acid. At 60%/wt. of phosphoric acid, the cathode potential is about 0.34 volt at pH 1.8 and about 0.7 volt at a pH of about 3.4. These values are as determined with a ruthenium-coated graphite cathode. Uncoated graphite evidences a cathode potential of somewhat over 1 volt under these same conditions.

It is a relatively simple matter to prepare and operate with ruthenium-coated graphite cathodes. One need only add a small amount of ruthenium trichloride, for example, to the catholyte liquid of an operating cell containing an acidic catholyte containing phosphoric acid of 25 to 75%/wt. concentration and at a pH of 1 to 3. The trichloride dissolves in the phophoric acid and in a short time the coloration of the catholyte thus induced disappears and the cathode potential will be observed to decrease from a value somewhat over 1 volt to a low value between about 0.3 to about 0.7 volt depending on pH and phosphoric acid concentration as described above. The resulting reduction in cathode potential is stable over a range of phosphoric acid concentrations and catholyte pH with certainty up to a pH of 7 and possibly higher. One can completely change the catholyte liquid without affecting cathode potential. A coating of ruthenium of about 30 mg. per sq. meter of cathode surface is fully effective.

Similar coatings are not plated out or applied in this manner as an effective coating on the graphite cahtode from solution in other acids such as hydrochloric acid.

ANODE ELECTRODE AND ANODE POTENTIAL

Graphite anodes, however, serve very well because the highly-selective membrane effectively excludes transfer of phosphate ion and/or other catholyte ions from the catholyte to the anolyte and anode attack is virtually eliminated. Graphite anodes employed in electrolytic chlorine processes are frequently made of oil-impregnated graphite. Four different types of anodes were compared as to cathode potential when operating in circulated saturated aqueous KCl at 95°C. Cathode potentials measured with the Standard Calomel Electrode ("vs SCE" below) are as follows:

| Electrode | Anode Potential vs SCE-volts |
|---|---|
| 1. "DSA" (Electrode Corp.) | 1.04 |
| 2. "DSA" (Engelhard Corp.) | 1.06 |
| 3. Graphite (oil-impregnated; freshly machined) | 1.40 |
| 4. Graphite (oil-impregnated; | |

-continued

| Electrode | Anode Potential vs SCE-volts |
|---|---|
| anodized*) | 1.01 – 1.04 |

*Anodized in $KH_2PO_4$

Anodizing is easily and inexpensively applied to oil-impregnated graphite anodes. The clean and freshly-machined anode is suspended in an electrolytic cell as an anode employing as an electrolyte a fairly concentrated solution of an alkali metal hydroxide or salt of an alkali metal such as sodium hydroxide, potassium hydroxide, sodium carbonate, potassium dihydrogen phosphate, dipotassium monohydrogen phosphate, the corresponding sodium phosphate salts, and many others. Current at commercial operating densities is then passed through the cell for a short period, usually for 10 to 30 minutes, until the anode acquires a satin-like distinctive appearance. The anode is then anodized and need only be washed with water and utilized in the process of this invention.

Ordinary graphite which is not oil-impregnated does not appear to require anodizing.

HIGH NORMALITY MEMBRANES

The characterization of ion exchange membranes under high ion concentrations as having a "normality" is not yet common and may not be fully understood. As employed herein, the term "normality" considers the membrane as a solid solution of electrolyte and is based on my new method of characterizing ion exchange membranes as described in my paper entitled "A New Method of Characterizing Ion Exchange Membranes" presented before the International Society for Electrochemistry, Brighton, England, Sept. 22–27, 1974.

Figure 10:
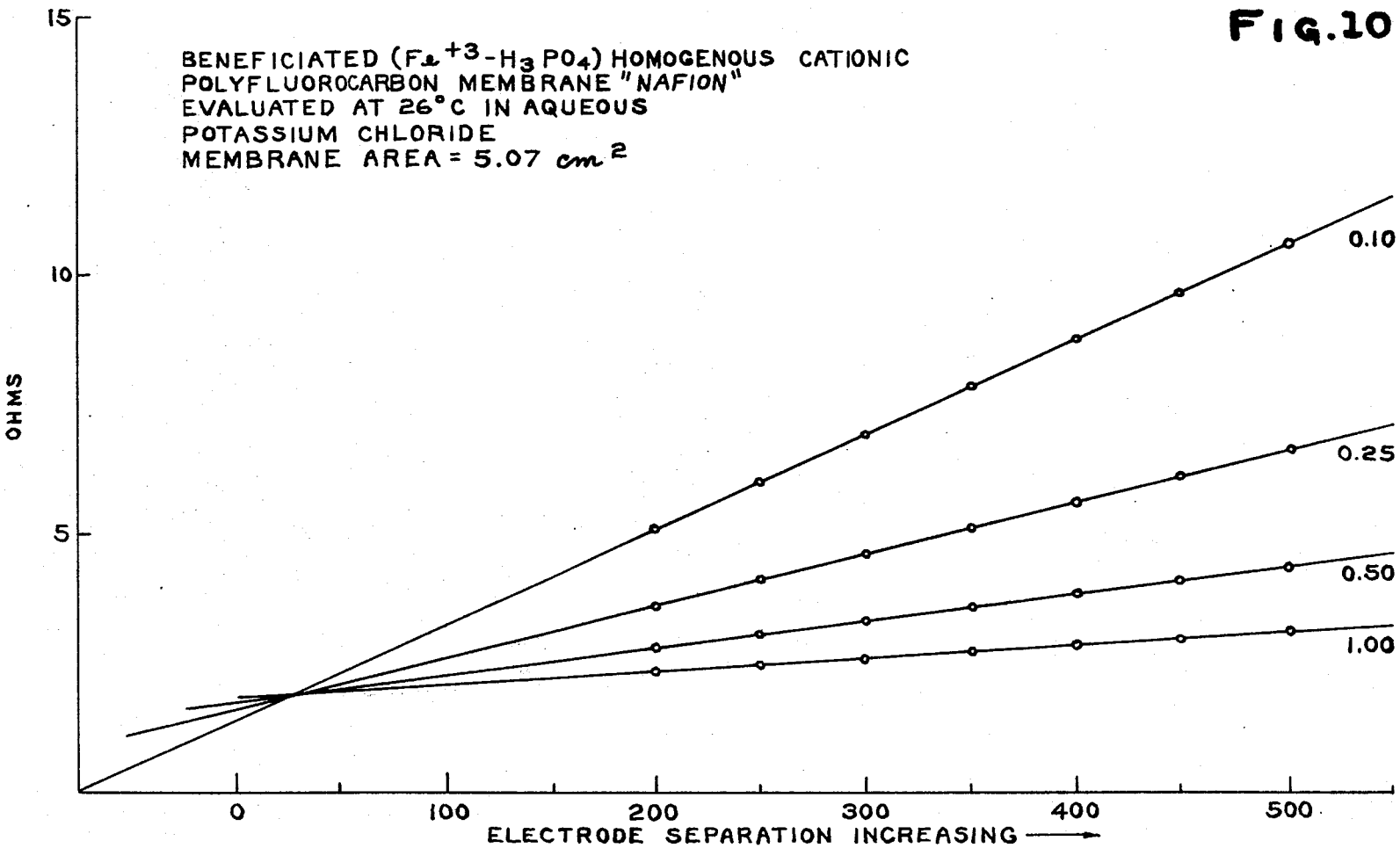
FIG. 10 is a representative plot of data utilizing a homogeneous cationic polyfluorocarbon membrane beneficiated with iron phosphate ions and KU as the electrolyte.

In such method the test membrane is mounted in a special conductivity cell having movable silver or graphite electrodes and employing a pure A.C. signal at 1000 Hz. The compartments on each side of the membrane are filled with the same solution of electrolyte which, for the purposes of this invention, is an alkali metal chloride. The procedure involves measuring the cell resistance at a number of electrode spacings and repeating the same measurements at each of a number of successively higher concentrations of the same electrolyte. The data at each electrolyte concentration is then plotted with electrode gap as abscissae and cell resistance in ohms as ordinates. The data points at each electrolyte concentration form a straight line which can be extrapolated to the left to the zero spacing axis. The lines so plotted at all electrolyte concentrations below the "critical electrolyte concentration" (or CEC herein) should intersect at a common point which I believe to be resistivity, per se, of the membrane and which is an inherent characteristic of the membrane in question in the particular electrolyte utilized. FIG. 10 of the drawings shows a family of plot lines obtained with this method.

As the concentration of the electrolyte is increased, eventually a concentration is reached at which the plotted line no longer passes through te common point of intersection at zero electrode separation. Such a concentration is taken as the "critical electrolyte concentration" or "CEC" since the test membrane no longer is able to reject the coions and the latter penetrate the membrane and contribute significantly to the conductivity of the membrane. At all concentrations below CEC, the membrane rejects coions essentially completely. By definition at CEC, the effective electrolyte concentration of the solution and of the membrane are essentially equal.

The higher the CEC, the greater will be the permselectivity of the membrane. The use in the test cell of the electrolyte of the ion exchange process will yield at least a qualitative prediction of the suitablility of the membrane in the cation exchange process in question.

Any deviation of measured conductivities from published values and any deviation from strict linearity of the plot lines reveals malfunction of equipment or poor technique. Since the same electrolyte is on each side of the membrane, the opposing effects of transport of water and of changing electrolyte concentration are eliminated. Lastly, the method measures an average electrolyte concentration rather than point values as do the membrane potential methods of the prior art. There is some indication that even the finest cation exchange membranes vary in anion site density across their exposed surface.

Cation exchange membranes now available commercially exhibit a CEC between about 0.01 and about 0.11 N. Membranes for use in the process of this invention should exhibit a CEC of at least 0.5N, and better yet between about 0.5 and 10N or more. Such high-normality membranes are easily prepared by any of several inexpensive techniques shown in my copending application, Ser. No. 582,707 filed on June 2, 1975 and referred to above.

Commercially available membranes permit greater transport of phosphate than desired.

In contrast to the above, and as described more fully in my copending application mentioned above, when these same membranes are treated so as to acquire additional nonattached (i.e. not covalently-bound) multivalent anion sites, they acquire the ability to reject both nonionized salts and anions, even at the very high ion concentrations obtaining in the method of the present invention. Also, the resulting "beneficiated" high-normality membranes exhibit a materially higher conductivity (i.e. a lower membrane IR drop) and transport the alkali metal anions to the catholyte at very high rates. All of these advantages are obtained while the membrane retains essentially all of its original strength and physical integrity.

The anions thus added to the ion exchange channels of the cation exchange membrane must exhibit at least two negative charges per anion and such negative charges preferably should not be located too remotely one from the other on the anion lest they be unable fully to coact in repulsion against the like charge sites covalently-bound to the material of the membrane. It is envisioned that a form of push-push repulsion or "electrostatic entrapment" is required lest the added anions be leached out of the membrane by water or the aqueous cell liquors. I have found that the beneficiated membrane may be washed with water without substantial reduction in the concentration of the electrostatically-entrapped anions. Moreover, if the original membrane materials can be dried without loss of ion exchange capacity, its beneficiated derivative can also be dried and when reimmersed in water and/or aqueous cell solutions exhibits ion exchange capacity as it did before drying.

The many and varied beneficiation treatments are more fully described in my copending application mentioned above. For the purposes of this invention, I shall describe only two such treatments, one of which may be termed a "deposition" type and the other of which is the in situ chemical formation route.

The deposition mode can either be carried out in a commercial chlorine cell or by separate treatment steps applied to the membrane before installation in the cell. First the membrane is swollen to its maximum extent by soaking in an aqueous solution of phosphoric acid. The membrane is then allowed to drip nearly dry or the membrane is sponged nearly dry. It is then immersed in a very dilute aqueous solution of a polyvalent metal salt such as ferric chloride, ferric nitrate, and the like for a period of 15 minutes to 1 hour. The membrane is then washed with water and it is ready for installation in the cell. The metal compound reacts with the imbibed phosphoric acid forming iron or phosphate on the surface and for at least a small distance into the member. When the membrane is placed in an electrolytic cell of the present invention, the metal phosphates are ionized by the current flow and may be driven deeper into the ion exchange channels of the membrane. Beneficiated membranes of this type are especially rugged and long lasting in service. It will be observed that the IR drop across such a membrane is low and remains low in the region of 0.05 to 0.50 volt at 100 A/sq.ft. with many hours of stable operation easily obtainable with IR drops in the range of only 0.3 and 0.4 volt.

The IR drop across the cell equipped with such a membrane will decrease further when the anolyte concentration is increased for steady-state chlorine production. With membranes of normality specified herein and at steady state operation near anolyte saturation with the optimum temperature of about 98°C and optimum catholyte concentration and pH, the total IR drop across the membrane at a current density of about 100 Amp.sq.ft. is consistently measured with a high impedance digital voltmeter at between about 0.05 and about 0.5 volt. Under these conditions, the total voltage per cell is about 2.0 volts (catholyte pH 4) a very low value compared to the reported voltage values (up to 3.8 volts) with prior art processes operating with either mixed $KCl/H_3PO_4$ single-solution or two-solution electrolytes. When so operated, the current efficiency of my process is essentially equal to the theoretical requirements since over 99% of the current flow has been accounted for by the quantity of the chlorine recovered.

The in situ chemical reaction mode of beneficiating cation exchange membranes is not so well adapted to being carried out in a chlorine cell. One version of this method is carried out by first soaking the membrane in diphenyl ether containing triphenyl amine or other electrically-neutral but readily polysulfonatable organic chemical reagent or reagents until thoroughly swollen. The swollen membrane is then exposed to the vapors of electrically-neutral sulfur trioxide over fuming sulfuric acid for several hours at room temperature. The membrane is then washed with water and/or alcohol and is ready for use in the cell. In this procedure, both the diphenyl ether and the triphenyl amine absorbed by the membrane are polysulfonated in situ depositing a mixture of strong organic sulfonic acids in the ion pathways of the membrane. Such sulfonic acid deposits are highly ionized when current flow is established in the cell yielding a very high density of bulky $—SO_3^=$organic anion sites which are not chemically combined with the ion exchange resin but are merely electrostatically entrapped therein.

Neither the nature of the cation exchange resin portion per se of the membrane nor the particular mode of beneficiation applied to the membrane is critical to the successful operation of the present process although the membranes beneficiated by the deposition of iron phosphate groups are particularly rugged and stable during use. It is critical, however, that the beneficiated membrane have at least a minimal effective anion density in order for the membrane to remain free of salt deposits and to have at least a minimum permselectivity, high conductivity and low resistivity. For use in the process of this invention, beneficiated cation exchange membranes should possess an effective anion concentration from about 0.5N or 1N up to about 10N, more preferably between about 3N and 4N with between about 0.05N and about 0.15N being accounted for as the covalently-bound, negatively-charged anion sites of the original membrane. The trapped and covalently-bound anions need not be the same since the XR-type membrane described above when iron phosphate treated will contain covalently-bound$=SO_3$ groups and trapped iron phosphate anions.

CATHOLYTE CONCENTRATION-SOLUBILITY/CONVERSION CONSIDERATIONS

FIGS. 1 and 2 should be referred to in connection with the description to follow. As shown in FIG. 1, the composition of the various potassium phosphate are portrayed by K:P ratio lines, $KH_2PO_4$ represented by the line labelled "1:1K:P"; $K_2HPO_4$ by the line labelled "2:1K:P"; and $K_3PO4$ by the line marked "3:1K:P". Note that of the three phosphates, the $KH_2PO_4$ salt is formed at the lowest $P2O_5$ concentration in the catholyte compartment of the cell. $KH_2PO_4$ also is the last soluble in water of the three phosphates. It is advantageous to operate at relatively higher K:P ratios in the catholyte solution having a K:P ratio between about 1.5 and about 2.5 because one can withdraw such higher K:P catholyte from the cell and add phosphoric acid thereto to lower the effective K:P ratio, if desired to about 1:1 to produce the desirable $KH_2PO_4$ salt or to any value between about 0.5:1 to about 2:1 needed for a given fertilizer application.

FIG. 2 of the drawings shows the solubility limits of the $KH_2PO_4$ salt at three temperatures (20°C; 75°C; 95°C) as indicated by three dotted lines each labelled by appropriate legends on the right-hand margin of the plot. All solutions of composition located just above the "95°C"line will contain solid $KH_2PO_4$ precipitates at all temperatures usable in the process. The $KCl/H_3PO_4/KH_2PO_4$ process of this invention should be operated at catholyte compositions below the point of precipitation of $KH_2PO_4$, especially in large scale commercial operations employing multi-celled bipolar cells (see FIG. 10) having close spacing of the members of each cathode/membrane/anode "sandwich". Since anolyte and catholyte solutions are circulated continuously at appreciable flow rates through each sandwich of the multi-cell structure, suspended solids in the solutions would erode the membrane and graphite electrodes and possibly lead to solids bridging the short current pathway. Release and separation of the chlorine and hydrogen gases also would be appreciably impeded by suspended solids.

FIG. 2 indicates compositional changes in a catholyte solution as, respectively, crystallization of $KH_2PO_4$ occurs, distillation of the remaining liquor, addition of 75% $H_3PO_4$ and electrolysis.

ALTERNATIVE CATHOLYTE SOLUTION WORK-UP PROCEDURES

A catholyte sidestream removed from the cell can be treated in many ways to reduce the concentration of the alkali metal phosphate salt therein. The simplest treatment consists in cooling the catholyte in a crystallizer apparatus to effect crystallization of a portion of the phosphate salt which can be isolated by filtering or centrifuging. The crystallization liquor, depending on the lowest temperature to which it is cooled will still contain dissolved phosphate salt. The effect of the latter is to shorten the conversion line A in FIG. 1.

A slight variation of the crystallization technique is to distill water from the hot catholyte solution as it comes from the cell and then pass the more concentrated still bottoms stream to the crystallizer to produce a higher yield of the phosphate salt and produce a filtrate of higher phosphoric acid concentration.

To produce a wider swing in conversion and produce a recycle catholyte liquor exhibiting a lower pH, one can add to the catholyte solution leaving the cell a 1 to 4 carbon atom monohydric alcohol such as methanol along with cooling to effect a nearly complete precipitation of the alkali metal phosphate salt. After isolation of the yield of solid salt, the alcoholic $H_3PO_4$ filtrate is distilled to recover the alcohol or remove all of the alcohol and a portion of the water to produce a recycle $H_3PO_4$ solution to which additional makeup acid can be added, if needed.

Depending on the needs of the fertilizer industry, there are additional alternative catholyte work-up procedures possible. For example, a catholyte solution produced at high conversion-per-pass of 85–95% can be made alkaline with a nitrogen base such as gaseous ammonia urea or melamine or their formaldehyde "perform" reaction products, before an alcohol addition step. After adding alcohol to effect precipitation of essentially all of the salt content of the resulting neutral or alkaline solution, there is produced a filtrate which can be disposed of since the original phosphoric acid content has been neutralized and removed. In such a mode of work-up, the hydrogen atoms of $KH_2PO4$ or $K_2HPO_4$, and of the hydrogen atoms of any remaining free $H_3PO_4$ have been replaced by base producing a mixture of salts which can be an ideal fertilizer additive furnishing all three of the nitrogen: potash:phosphate nutrient requirements in usable form. If a fertilizer additive of reduced potassium and phosphate release rates is desired, $KH_2PO_4$ crystals should be isolated and heated to effect condensation to forms possessing lower water solubilities.

EXAMPLE I

An oil-impregnated graphite anode is anodized in $KH_2PO_4$ as described above and then installed in a monopolar cell having no membrane and filled with an aqueous solution containing 35%/wt. of $H_3PO_4$. A graphite cathode is installed parallel to the anode and separated therefro by 1mm. The flow of current at 100 milliamps per $cm^2$ is commenced. The cell is of a liter or less capacity. A few drops of a solution of $RuCl_3 \cdot 3H_2O$ is added to the phosphoric acid and current flow is continued for a total of 30 minutes thereafter.

The resulting ruthenium-coated cathode is installed in one half of a bipolar cell containing an anodized graphite anode and an iron-phosphate beneficated membrane. In the other half of the cell an anodized graphite anode (see text under "Anode Electrode and Anode Potential") is similarly installed on each side of a similar beneficated electrode. The anolyte in both halves of the cell is saturated KCl solution and the catholyte is an aqueous solution containing 35%/wt. of phosphoric acid. The anolyte pH is 1.45 to 1.50 and the catholyte pH is in the range of 4.5 – 6.95. At steady state, the cathode potentials at each cathode is measured periodically during the run. The cathode potential of the ruthenium-coated graphite cathode is consistently determined to be in the range of 0.65 – 0.75 volt whereas the similar uncoated graphite cathode exhibited a cathode potential of 0.93 – 0.96 volt. A few drops of $RuCl \cdot 3H_2O$ solution are added to the catholyte in contact with the uncoated cathode. Almost immediately the cathode potential drops to 0.65 volt. This experiment shows that the ruthenium coating can be applied either before the cathode is installed in the cell or it can be applied during regular cell operation.

I claim:

1. In a method of producing elemental chlorine by electrolysis of an alkali metal chloride and phosphoric acid in aqueous solution, the improvement which comprises placing a hot aqueous concentrated anolyte solution of said alkali metal chloride in contact with one side of the cation exchange membrane and a hot aqueous catholyte solution of phosphoric acid containing from about 10% to about 70%/wt. of phosphoric acid in contact with the other side of said membrane, using a graphite cathode in the catholyte solution, passing a direct current in series through said solutions and membrane, said cation exchange membrane having a concentration of multivalent anions between about 0.2 and about 10N with the great preponderance of said anions being electrostatically trapped in the ion exchange channels of said membrane, and said solutions being at a temperature between about 90° and about 100°C, collecting chlorine gas from said anolyte solution, collecting hydrogen gas from said catholyte solution, and recovering as a product from said catholyte solution at least a portion of an alkali metal phosphate formed therein.

2. The method as defined in claim 1 and further characterized by the pH in the said anolyte solution being maintained in the range of from about 1 to about 5.

3. The method as defined in claim 1 and further characterized by the said alkali metal chloride being potassium chloride, by the said catholyte solution being maintained at a pH of between about 1.0 and about 5 by adding phosphoric acid to said catholyte solution, and by said alkali metal phosphate being principally $KH_2PO_4$.

4. The method as defined in claim 1 and further characterized by the said alkali metal chloride being potassium chloride, by the pH of the said catholyte solution being regulated at a value in the range of between about 5 and about 9, and by the said alkali metal phosphate being $K_2HPO_4$.

5. The method as defined in claim 1 and further characterized by the said alkali metal chloride being potassium chloride, by the said current being established between an anode electrode of anodized oil-impregnated graphite and a ruthenium-coated graphite cathode, by said catholyte being maintained at a pH between about 1.5 and about 10, and by said alkali metal phosphate being a potassium phosphate of a $K_2O/P_2O_5$ ratio determined by said catholyte pH.

6. The method as defined in claim 1 and further characterized by the flow of said current being established from an anode electrode of anodized oil-impregnated graphite immersed in said anolyte solution.

7. The method as defined in claim 1 and further characterized by the flow of said current being established from a cathode electrode of ruthenium-coated oil-impregnated graphite immersed in said catholyte solution.

8. The method as defined in claim 1 and further characterized by said cation exchange membrane in which said multivalent anions comprise a concentration of covalently-bound+$SO_3$ anions between about 0.05 and about 0.1N and the remainder electrostatically trapped iron phosphate anions.

9. In a method of producing elemental chlorine by electrolysis of potassium chloride and phosphoric acid in aqueous solution, the improvement which comprises employing the named ingredients as separate aqueous solutions in direct contact with the opposite sides of a beneficiated cation exchange membrane, said cation exchange membrane being a high normality membrane of homogenous polyfluorocarbon polymer containing about 0.01N of covalently-bonded $SO_3H$ groups and entrapped polyvalent anions and exhibiting a critical electrolyte concentration between about 0.5 and about 10N, each said solution being maintained at a temperature between about 90° and 98° C the resulting potassium chloride anolyte solution containing between about 0.4 and about 0.567 gram of KCl per gram of water and the resulting catholyte solution containing between about 25% and about 60%/wt. of phosphoric acid; using a graphite cathode in the catholyte solution, passing a direct current in series through said anolyte solution, said membrane and said catholyte solution; adding water and potassium chloride to said anolyte solution as electrolysis proceeds while collecting chlorine gas from the said anolyte solution; and collecting hydrogen gas from said catholyte solution, separating therefrom a potassium phosphate, and adding phosphoric acid thereto to maintain therein the concentration of phosphoric acid and a pH in the range of between about 1.0 and about 10 as electrolysis proceeds.

10. The method as defined in claim 9 and further characterized by the added steps of separating portions of said catholyte solution, adding a nitrogen base thereto in proportions substantially to neutralize the resulting solution, adding to the resulting neutralized solution a 1 to 4 carbon aliphatic alcohol to effect precipitation of the salt content thereof, and recovering from the resulting mixed precipitated solution a solid fertilizer product of the desired $N:K_2O:P_2O_5$ ratio.

11. The method as defined in claim 9 and further characterized by the pH of said catholyte solution being maintained at a pH of between about 1.5 and about 4 by addition of phosphoric acid, and the said potassium phosphate therein being $KH_2PO_4$.

12. The method as defined in claim 9 and further characterized by the pH of the said catholyte solution being maintained at a pH between about 5 and about 12 by addition of phosphoric acid, and the said potassium phosphate therein being $K_2HPO_4$.

13. The method as defined in claim 9 and further characterized by said current being maintained between an anode of anodized oil-impregnated graphite and a cathode of ruthenium-coated graphite.

* * * * *